US007001668B2

(12) United States Patent
Banman

(10) Patent No.: US 7,001,668 B2
(45) Date of Patent: Feb. 21, 2006

(54) TROPHY CONSTRUCTION

(75) Inventor: John Banman, South El Monte, CA (US)

(73) Assignee: Plastic Dress-Up Co., South El Monte, CA (US)

( * ) Notice: Subject to any disclaimer, the term of this patent is extended or adjusted under 35 U.S.C. 154(b) by 85 days.

(21) Appl. No.: 10/729,303

(22) Filed: Dec. 5, 2003

(65) Prior Publication Data

US 2004/0191430 A1 Sep. 30, 2004

Related U.S. Application Data

(63) Continuation-in-part of application No. 10/402,733, filed on Mar. 31, 2003, now Pat. No. 6,828,034.

(51) Int. Cl.
*B44C 5/04* (2006.01)

(52) U.S. Cl. ..... 428/542.4; 428/13; 428/913.3; 40/358; D11/131; D11/164

(58) Field of Classification Search ..... 428/542.4, 428/13, 913.3; 40/358; D11/131, 164
See application file for complete search history.

(56) References Cited

U.S. PATENT DOCUMENTS 2,818,293 A * 12/1957 Klein et al. ..... 403/372

* cited by examiner

*Primary Examiner*—Ling X. Xu
(74) *Attorney, Agent, or Firm*—James E. Brunton, Esq.

(57) ABSTRACT

An award construction that includes a decorative member, a supporting base for supporting the decorative member and an alternate means for interconnecting the decorative member with the supporting base. More particularly, in one form of the invention, the base portion of the decorative member includes a peripheral portion having a locking rim than can be lockably interconnected with a yieldably deformable locking assembly that is affixed to and extends upwardly from the upper surface of the supporting base. In another form of the invention, the identical base portion of the decorative member can be interconnected with the support base by means of a threaded rod which is threadably received within a threaded bore formed in the base portion of the decorative member.

14 Claims, 6 Drawing Sheets

22
24
24a
24b
25
26
28
28a
30
30a
32
42
44
44a
46
48
48a
50
7

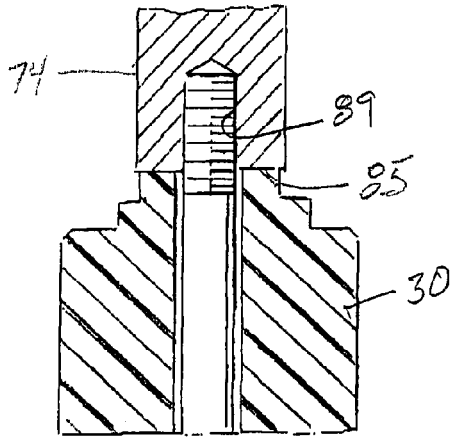
FIG. 12
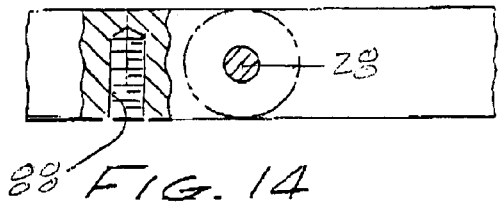
FIG. 14
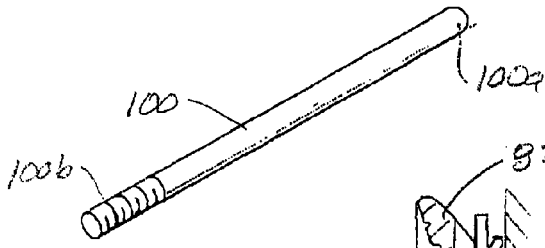
FIG 15
FIG 13
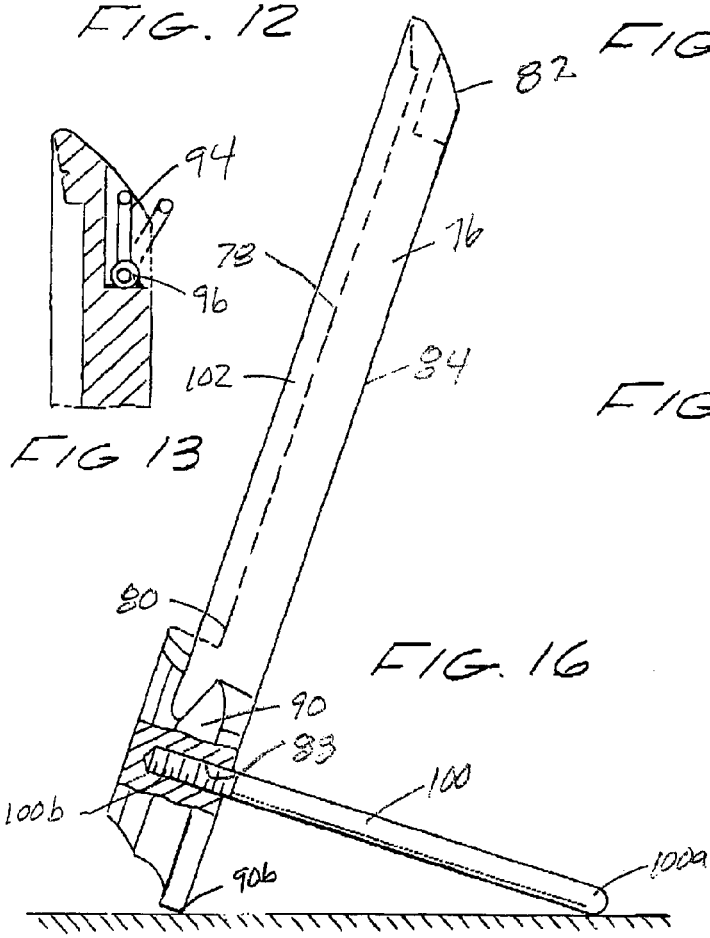
FIG. 16
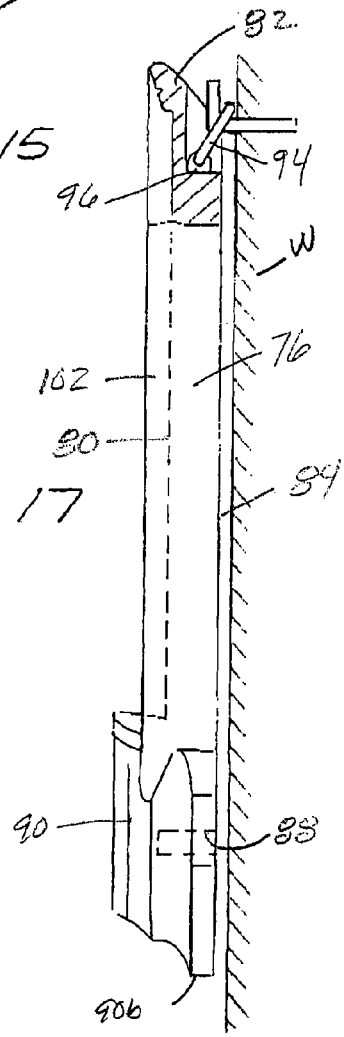
FIG. 17

TROPHY CONSTRUCTION

This is a Continuation In Part of application U.S. Ser. No. 10/402,733 now U.S. Pat. No. 6,828,034 filed on Mar. 31st 2003.

BACKGROUND OF THE INVENTION

1. Field of the Invention

The present invention relates generally to achievement awards. More particularly, the invention concerns an award trophy construction that includes a decorative member, a supporting base and alternate forms of connectors for interconnecting the decorative member with the supporting base.

2. Discussion of the Prior Art

Achievement awards of various types are frequently given to individuals and athletic teams for outstanding achievements in sports such as golf, bowling, tennis, baseball, basketball and the like. These awards include medals, plaques and a number of different types of small statues of which frequently take the form of a decorative member of an appropriate which frequently take the form of a decorative member of an appropriate design that is mounted on a supporting base.

Exemplary of one type of achievement award is that described in U.S. Pat. No. 5,834,073 issued to Greenblat and to the present inventor. This latter patent discloses an achievement award which comprises a substantially transparent, injection molded acrylic plaque, and a supporting base. The transparent plaque has a decorative design or image, which appears to be embedded in the central portion of the plaque. The central portion of the plaque includes a front face and a rear face wherein the fossil-like image is formed in the rear face. At the base of the central portion is a three-dimensional insert which is also injection molded. This insert connects the central portion to the base.

A very popular type of prior art trophy construction is depicted in FIG. 1 of the drawings of the present application. This construction comprises an injection molded decorative component such as a figurine or the like, a supporting base and a decorative riser column that extends between the supporting base and the decorative component. The base of the decorative component includes an outwardly extending threaded stud that is typically molded into the base of the decorative component during the molding process. This prior art trophy construction also includes an elongated connector rod having a first threaded end that can be connected to the threaded stud by means of an internally threaded coupler. The rod extends through the decorative riser and includes a second threaded end that protrudes into a cavity formed in the supporting base. A nut, which is threadably received over the second end of the rod, functions to interconnect the supporting base and the decorative riser. U.S. Pat. No. 5,322,739 issued to Stagl discloses a trophy construction of a somewhat similar configuration.

SUMMARY OF THE INVENTION

It is in object of the present invention to provide a novel trophy or award construction that includes a decorative member, a supporting base for supporting the decorative member and an alternate means for interconnecting the decorative member with the supporting base.

More particularly it is in object of the invention to provide a construction of the character described in the preceding paragraph in which the decorative member includes a base portion that is provided with alternate types of connector mechanisms for connecting the decorative member to a supporting base.

Another object of the invention is to provide an award construction of the aforementioned character that has alternate configurations. In one form of the invention, the base portion of the decorative member includes a peripheral portion having a locking rim that can be lockably interconnected with a yieldably deformable locking assembly that is affixed to and extends upwardly from the upper surface of the supporting base. In another form of the invention, the identical base portion of the decorative member can be interconnected with the support base by means of a threaded rod which is threadably received and within a threaded bore formed in the base portion of the decorative member.

In this latter form of the invention, the award construction includes a riser column which is disposed between the decorative member and the supporting base. The elongated threaded rod extends through the riser column and is interconnected with the supporting base by a threaded nut thereby providing an award construction having a completely different appearance from that of the first form of the invention.

Another object of the invention is to provide an attractive, ornamental display apparatus that can be mounted on a supporting base for supporting the decorative member, or alternatively can be conveniently positioned on a flat surface such as a desktop.

Another object of the invention is to provide an apparatus as described in the preceding paragraphs that can also be hung on a vertical surface such as a wall.

Another object of the invention is to provide an ornamental display apparatus of the aforementioned character that is uniquely molded from a moldable resin material.

Another object of the present invention is to provide an ornamental display apparatus as described in the preceding paragraphs, which includes a generally planer front surface having an upraised pattern provided thereon which depicts an athletic activity.

Another object of the present invention is to provide an ornamental display apparatus of the character described, which includes a generally planer front surface to which a plaque having an upraised pattern depicting and athletic activity can be bonded.

Another object of the invention is to provide an ornamental display apparatus which includes a generally planer front surface and a generally planer back surface to which a surface engaging support member can be removably connected when the apparatus is to be positioned on a desk or other flat surface. More particularly, it is an object of the invention to provide an ornamental display apparatus which includes a generally planer back surface that is provided with a threaded bore which is adapted to threadably receive one end of a surface engaging support member provided in the form of an elongated metal rod.

The foregoing features of the present invention and the manner of attaining the foregoing objectives will become more apparent, and the invention itself will be better understood from the following detailed description of the apparatus of the invention when read with reference to the accompanying drawings.

BRIEF DESCRIPTION OF THE DRAWINGS

FIG. 12 is an enlarged cross-sectional view taken along lines 12—12 of FIG. 9.

FIG. 13 is an enlarged cross-sectional view taken along lines 13—13 of FIG. 9.

FIG. 14 is a cross-sectional view taken along lines 14—14 of FIG. 9.

FIG. 15 is a generally perspective view of the rear support rod of the trophy plaque construction shown in FIG. 9.

FIG. 16 is a side elevational view, partly broken away to show internal construction, illustrating the use of the rear support rod shown in FIG. 15 to support the trophy plaque construction on a flat surface.

FIG. 17 is a side elevational, diagrammatic view illustrating the use of the hook arrangement shown in FIG. 13 to hang the trophy plaque on a wall.

DESCRIPTION OF THE INVENTION

Figure 1:
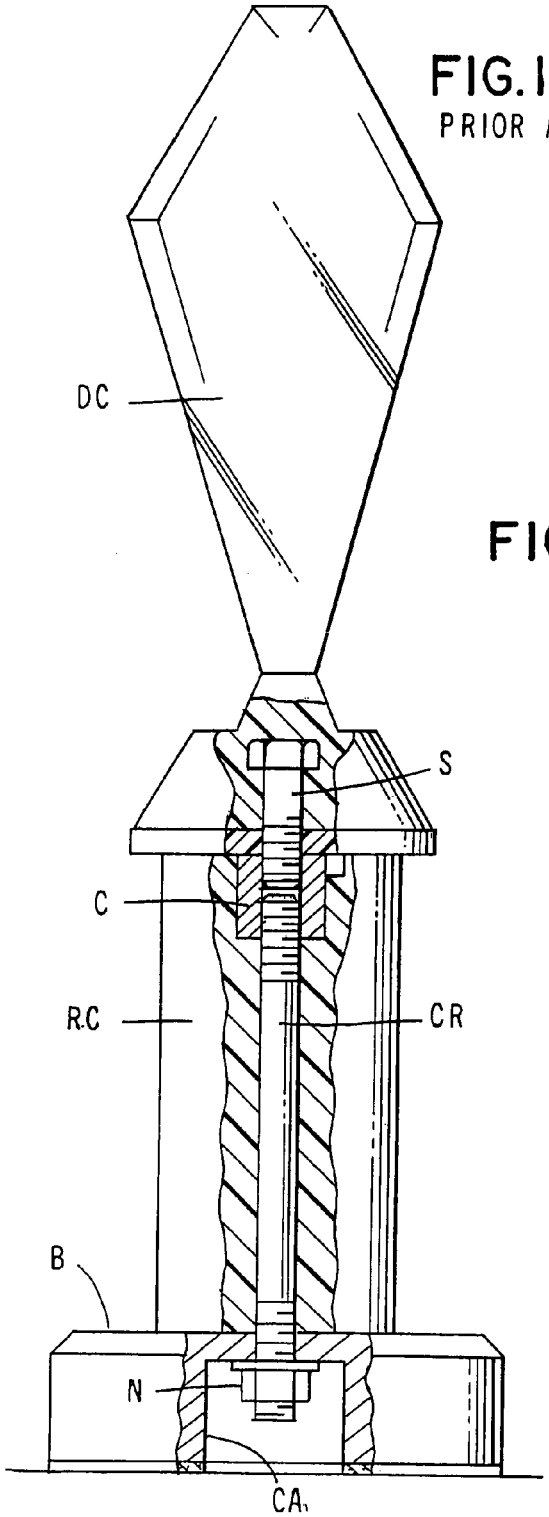
FIG. 1 PRIOR ART
FIG. 1 is a front view, partly broken away to show internal construction, of a prior art trophy construction that enables a bolt embedded into the base portion and the decorative component, an elongated tie rod and a threaded coupler for assembling the trophy components.

Referring to the drawings and particularly to FIG. 1, one form of a prior art trophy construction is there illustrated. As previously discussed, this type of prior art trophy construction comprises a decorative component "DC", a supporting base "B", and a decorative riser column "RC" that extends between the supporting base and the base of the decorative component. Molded into the base of the decorative component is a bolt having threaded stud "S" that extends downwardly from the base of the decorative component in the manner shown in FIG. 1. The prior art trophy construction also includes an elongated connector rod "CR" that can be interconnected with the stud "S" by means of an internally threaded coupler "C". The second end of the connector rod extends through an aperture provided in base "B" and into a cavity "CA" formed in the base. A threaded nut "N" functions to interconnect the assembly component in the manner shown in FIG. 1.

Figure 2:
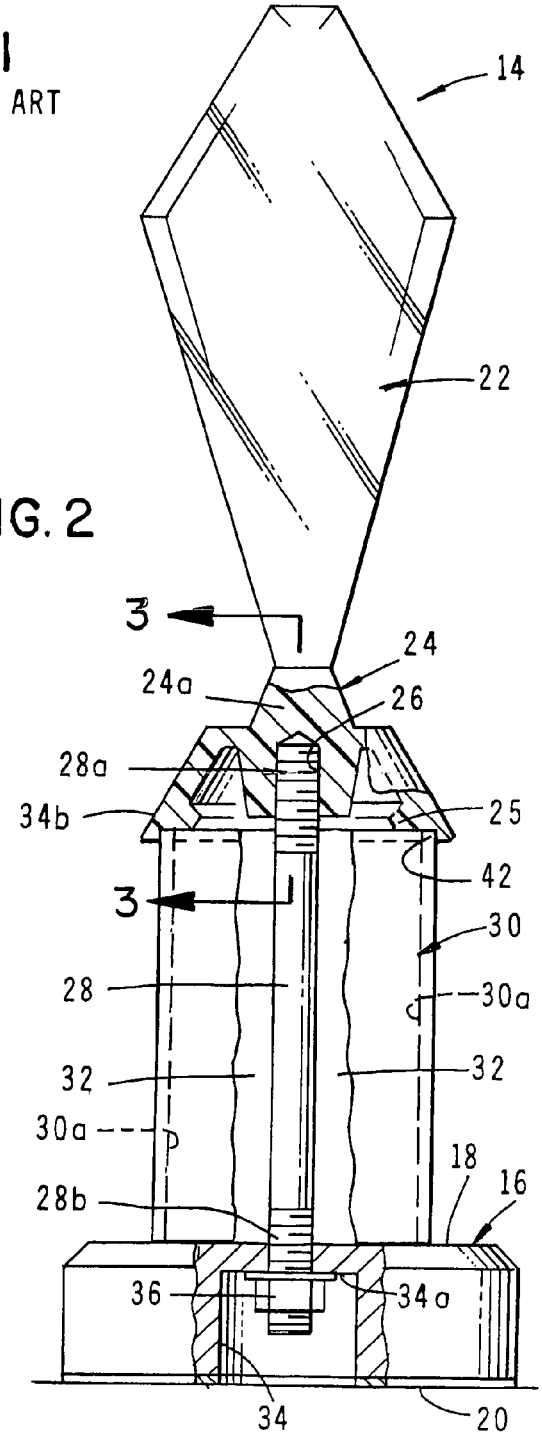
FIG. 2 is a front view one form of the trophy construction of the present invention.

Referring to FIG. 2, one form of the award device of the present invention is there illustrated and generally designated by the numeral 14. This form of the award construction comprises a supporting base 16 having an upper surface 18 and a lower surface 20. As will be discussed in greater detail in the paragraphs that follow, the decorative member 22 of the invention can be uniquely interconnected with base 16 in several different ways.

Figures 3, 4, 5, 6, 7:
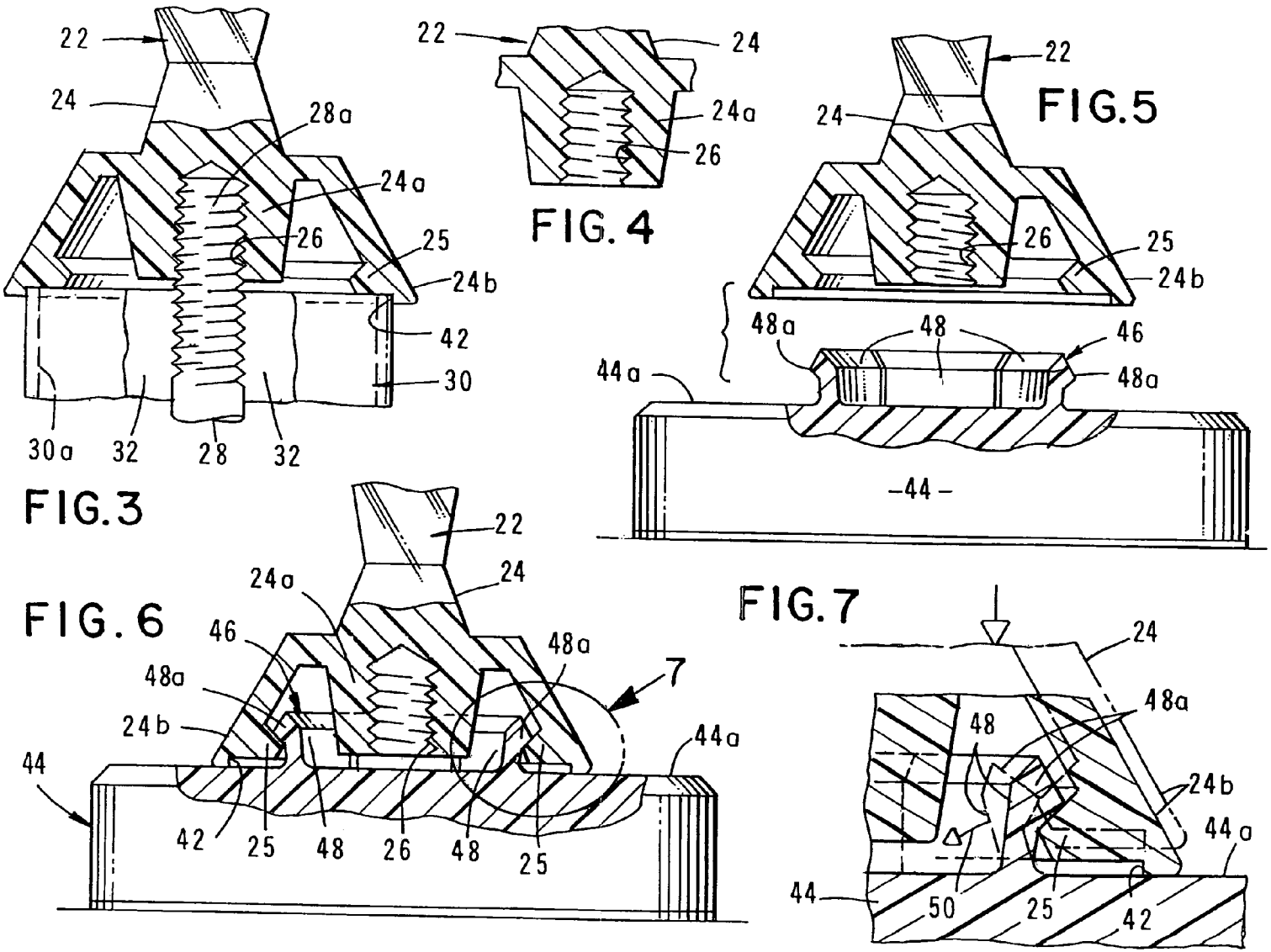
FIG. 3 is an enlarged cross-sectional view taken along lines 3—3 of FIG. 2.
FIG. 4 is a fragmentary cross-sectional view of a portion of the base of the trophy component.
FIG. 5 is an exploded front view, partly broken away to show internal construction, of an alternate form of the trophy construction of the present invention.
FIG. 6 is a view similar to FIG. 5, but showing the trophy component interconnected with the supporting base.
FIG. 7 is an enlarged, cross-sectional view of the area designated in FIG. 6 by the numeral 7.

As best seen in FIG. 3, decorative component 22 includes a base portion 24 that has a central portion 24*a* and a peripheral portion 24*b*. Peripheral portion 24*b* includes a radially inwardly extending connector or locking ring 25 and central portion 24*a* is provided with a threaded bore 26. The purpose of which will presently be described.

An important feature of the award construction of the present invention resides in the provision of a unique connector means for interconnecting the decorative member 22 with the supporting base 16. In the form of the invention shown in FIG. 2, this novel connector means comprises an elongated threaded rod 28 having a first threaded end 28*a* and a second threaded end 28*b*. As shown in FIG. 2, threaded end 28*a* is threadably receivable within internally threaded bore 26 so that the connector rod extends downwardly from the trophy component. Also forming a part of the award construction of the invention shown in FIG. 2 is a decorative spacer or riser member 30. The side wall 30*a* of the riser member defines a central space 32 for receiving downwardly extending connector rod 28. It is to be understood that riser portion 30 can take various forms such as a generally tubular shaped member have a decorative outer surface or a molded plastic member having a central rod receiving bore and a decorative outer surface. In either case, the threaded rod 30 extends downwardly through the spacer so that at least a portion of the threaded end 28*b* extends into a cavity 34 formed in base 16. To interconnect the various components together in the manner shown in FIG. 2, a threaded nut 36 can be threaded over second threaded end 28*b* of connector rod 28 and cinched down against the inner wall 34*a* of cavity 34 of the base 16.

Referring once again to FIG. 3, it is to be noted that peripheral portion 24*b* is provided with a counter bore 42 for closely receiving the upper extremity of spacer 30.

Turning next to FIGS. 5, 6, and 7, an alternate form of connector means of the invention for interconnecting the decorative member 22 with a base 44 is there shown. In this alternate form of the invention, base 44 is provided with locking means which extend upwardly from upper surface 44*a* of base 44 in the manner shown in FIG. 5. This unique locking means here comprises an upstanding locking assembly 46 that is made up of a plurality of spaced-apart, upstanding locking segments 48 that are movable from the expanded position shown in FIG. 7 to the compressed position shown by the phantom lines in FIG. 7. More particularly, the upper portion 48*a* of each of the segments 48 is uniquely tapered to that as the decorative member 22 is moved downwardly into locking engagement with the base 44 in the manner illustrated in FIG. 7, rim portion 25 of the decorative member. More particularly, as shown in FIG. 7, when the decorative member will engage the outer tapered surfaces 48*a* of the spaced-apart segments 48 forcing them to move yieldably inwardly in the direction of the arrow 50 of FIG. 7. This inward yieldable movement of the segments 48 will allow the decorative member to be snapped over the locking assemblage 46 and into the locked position shown in FIG. 6 of the drawings.

It is to be appreciated that in the form of the invention shown in FIGS. 5, 6, and 7, the same decorative member 22 as is shown in FIGS. 1 through 4 can readily be mated with base 44 using the alternate type of connector means shown in FIGS. 5, 6, and 7. In this way, the same decorative member 22 can be used to construct trophies of vastly different configurations such as the configuration shown in FIG. 2 and the configuration shown in FIG. 6.

It is apparent from the foregoing discussion that the trophy construction of the present invention is of a much improved, simpler design and is far easier and much less time consuming to assembly than the prior art trophy construction shown in FIG. 1. The trophy construction of the present invention is also easier and less expensive to fabricate since it eliminates various components. For example, in the trophy construction of the present invention, no coupler member is required to enable the interconnection of the components of the trophy, nor is the embedded bolt construction found in the prior art construction required. The molding step is easier and less expensive since a bolt need not be molded into the base of the decorative component and the cost of the coupler is eliminated. By forming the decorative component with an internally threaded bore 26 that directly receives the threaded end of the elongated connector rod 28, the assembly of the trophy is simplified. Additionally, by molding the decorative component with the uniquely designed peripheral portion, the component can readily be used in the assembly of an attractive trophy of an alternate configuration.

Figure 8:
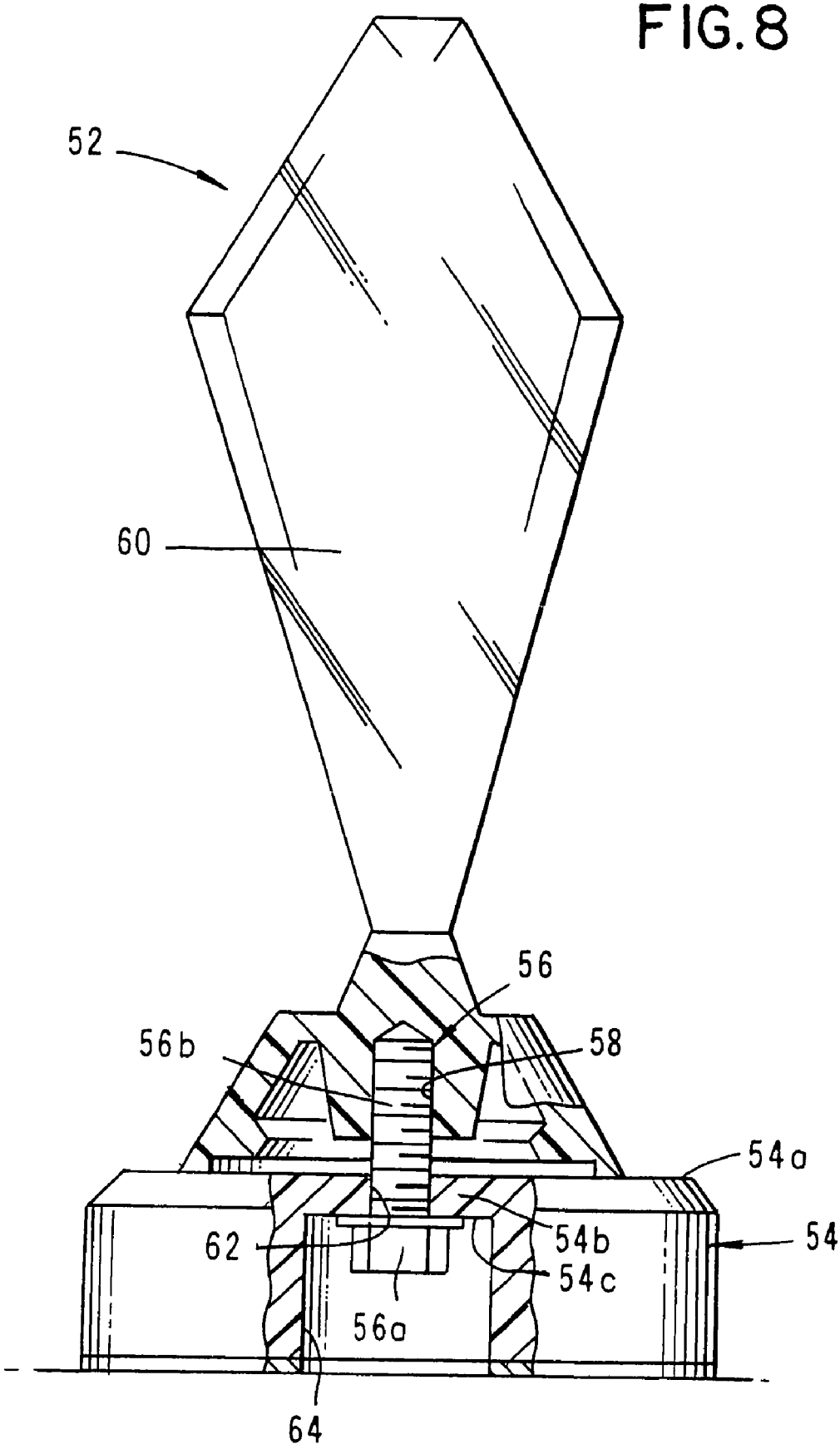
FIG. 8 is a front view, partly broken away to show internal construction, of still another form of the trophy construction of the invention.

Referring now to FIG. 8, still another form of the award trophy construction of the invention is there shown and generally designated by the numeral 52. In this latest form of the invention, base 54 is provided with a generally planar upper surface 54*a*.

The connector means here comprises a threaded bolt 56 having a head 56*a* and a threaded shank 56*b*. As shown in FIG. 8, threaded shank 56*b* is threadably receivable within an internally threaded bore 58 formed in the base portion of the decorative component 60 so that the threaded shank extends downwardly from the trophy component. Base portion 54 includes a top wall 54*b* having a bore 62 that communicates with a cavity 64 formed in the base. When the decorative member is assembled with the base, the head 56*a* of the bolt is disposed within cavity 64 do that the head of the bolt can be cinched down against the inner wall 54*c* of base 54.

As before, by molding the decorative component in the manner shown in the drawings, the component can readily be used in the assembly of an attractive trophy of the alternate configuration shown in FIG. 8.

Figure 9:
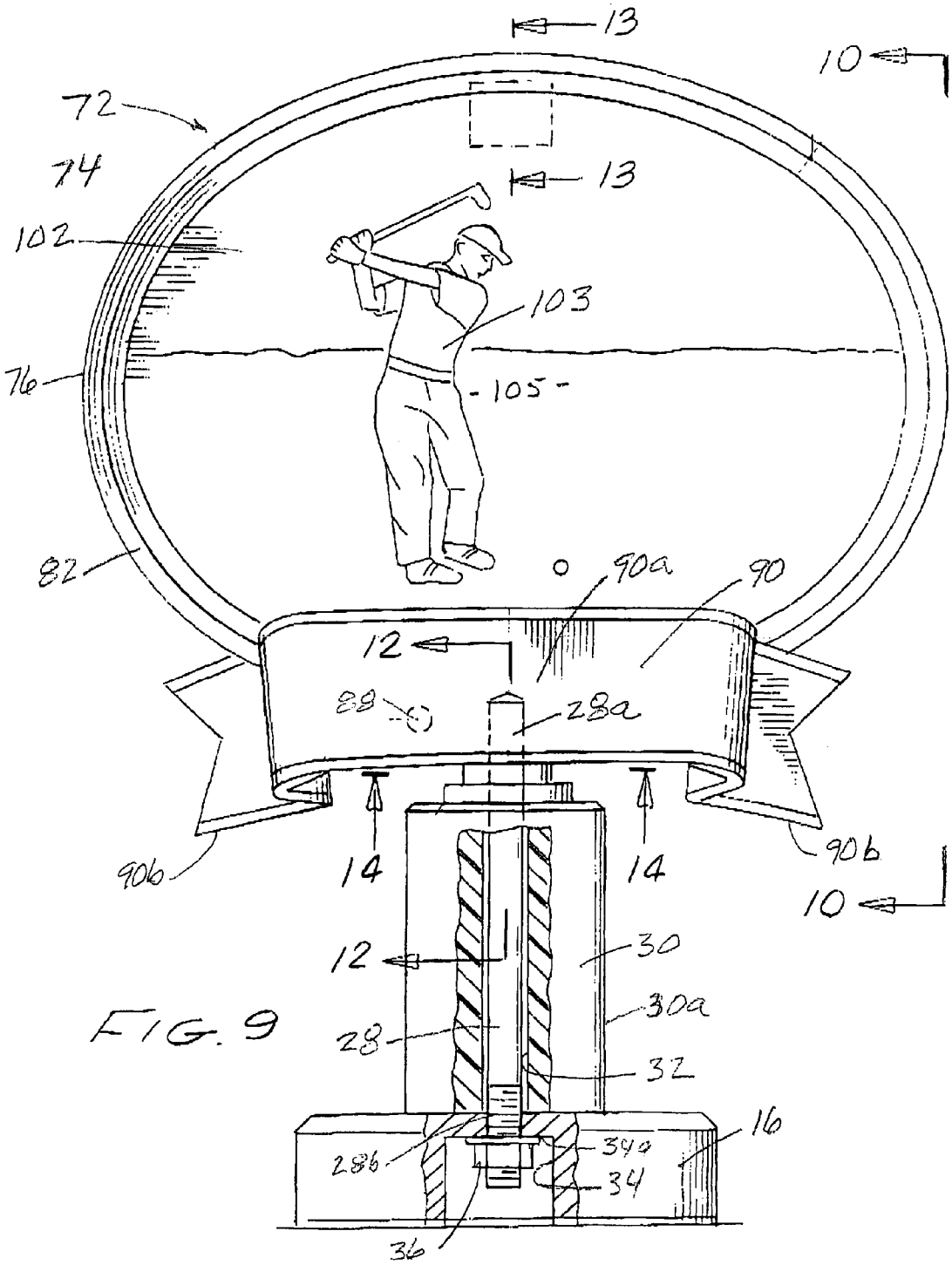
FIG. 9 is a front view, partly broken away to show internal construction, of yet another form of the trophy construction of the present invention.
Figures 10, 11:
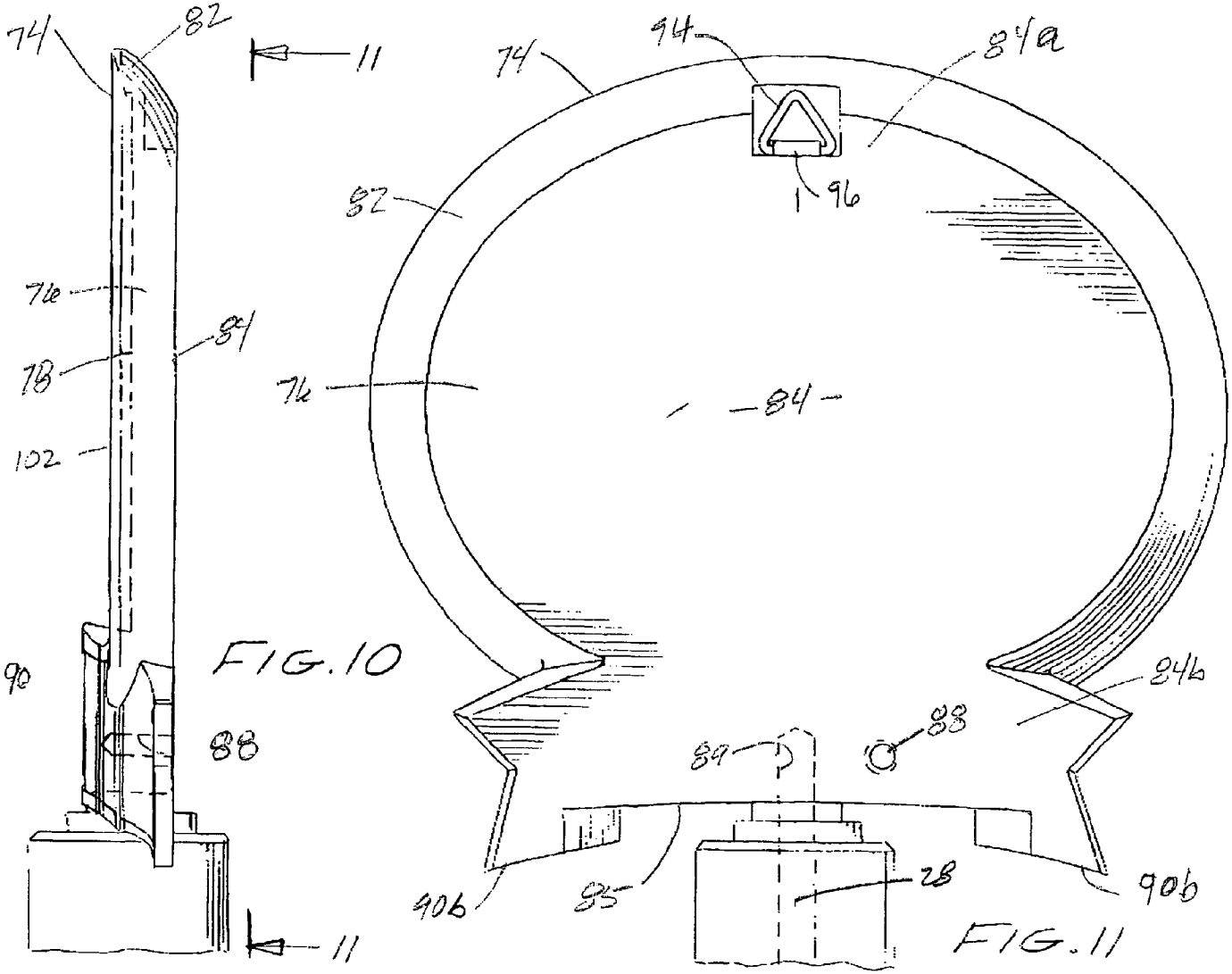
FIG. 10 is a view taken along lines 10—10 of FIG. 9.
FIG. 11 is a view taken along lines 11—11 of FIG. 10.

Turning next to FIG. 9, an alternate form of the apparatus of the invention is there shown and generally designated by the numeral 72. This latest form of the invention is similar in many respects to that shown in FIG. 2 of the drawings but illustrates the mounting of a totally differently configured decorative member on base 16. For sake of clarity, like numerals are used in FIG. 9 to identify like components. As illustrated in FIGS. 9, 10 and 11, decorative member comprises a moldable body portion 76 that includes a generally planar front surface 78 having a central portion 80 that is circumscribed by a marginal portion 82 (FIG. 10). As best seen in FIGS. 10 and 11, molded body 76 also includes a generally planar back surface 84 having an upper portion 84*a* and a lower portion 84*b*. Provided in the lower portion 84*b* of the back surface is a first threaded bore 88, the purpose of which will presently be described.

The lower surface 85 (FIG. 12) of molded body 76 also includes a generally vertically extending, second threaded bore 89 that is adapted to receive the upper threaded portion of the previously identified threaded connector member 28 so that the decorative member can be interconnected with base 16 in the manner earlier described herein. The details of the method of connecting molded body 76 to base 16 will be further described in the paragraphs which follow.

The front surface 78 of molded body portion 76 includes a lower portion 90 that, as best seen in FIG. 9, is generally ribbon shaped, that is, has a configuration that simulates the shape of a ribbon, such as an award ribbon. Ribbon shaped lower portion 90 includes a central portion 90*a* upon which indicia, such as the name of the recipient of the award, the name of the team being honored or other suitable indicia and the like, can be engraved or otherwise affixed. Provided at the lower, spaced-apart outward portions of the ribbon-like portion are surface engaging protuberances 90*b*. These protuberances are adapted to engage a planar surface, here shown as the upper surface of the paper upon which FIG. 16 appears. In actual use, this planar surface can take the form of a desk top, the top of a shelf, the top of a cabinet or a like planar surface.

Affixed to back surface 84 of the body portion proximate the marginal portion 82 is hanger means for hanging the display apparatus on a vertical surface such as a Wall or the like (FIG. 17). In the present form of the invention, this hanger means comprises a generally triangular shaped, metal hanger member 94 that is pivotally connected to the upper portion: 84*a* of the back surface 84 (FIG. 11). For this purpose, the back surface of the body portion is provided with a hollow sleeve 96 that telescopically receives the lower, horizontally extending leg of the triangularly shaped hanger member so that this lower leg can freely rotate within sleeve 96.

Forming an important aspect of the present invention is the provision of a metal support rod 100 that, as shown in FIG. 15, includes a first, rounded surface engaging end 100*a* and a second threaded end 100*b*. Second, threaded end 100*b* is threadably received within the previously identified first threaded bore 88 formed in the back surface of the molded body. When the support rod is interconnected with the molded body, the support rod will extend substantially perpendicularly from back surface 84 so that when the surface engaging end 100*a* is moved into engagement with the supporting surface in the manner shown in FIG. 16, the front surface of the plaque will tilt rearwardly at an optimum angle with respect to the surface upon which the apparatus rests so that the face of the plaque can be easily viewed.

Forming another important feature of the present invention is the provision of an ornamental molded plaque 102 which, as illustrated in FIGS. 9 and 16, can be interconnected with front surface 78. As illustrated in FIG. 9, molded plaque 102 is provided with an upraised portion 103. Molded plaque 102 can be interconnected with front surface 78 by bonding or by other suitable interconnection means. When plaque 102 is bonded to the body portion, the apparatus comprises an integral unit having a front face provided with the upraised pattern 103 depicting an athletic activity.

The embodiment of the invention shown in the FIGS. 10 and 11 of the drawings comprises a body portion that includes a front surface 78 having a central portion 105 that is generally oval in shape. However, it is to be understood that this surface can have any number of different shapes including rectangular, triangular, circular, hexagonal and octagonal depending on the end use of the apparatus.

Similarly, plague 102 can be of various shapes corresponding to the shape of central portion 105. The apparatus can be provided in various colors. As for example, the face of the plaque can be silver in color while the margin can be gold in color. Alternatively, the face of the plaque can be gold and the margin can be silver.

Considering now the interconnection of decorative member 72 with base 16, as previously described herein, threaded end 28*a* of threaded rod 28 is threadably receivable within internally threaded bore 89 so that the connector rod extends downwardly from the trophy component. Also forming a part of the award construction of the invention shown in FIG. 9 is a decorative spacer or riser member 30 which is of the character previously described. As before, the side wall 30*a* of the riser member defines a central space 32 for receiving downwardly extending connector rod 28. As indicated in FIG. 9, the threaded rod 28 extends downwardly through the spacer so that at least a portion of the threaded end 28*b* extends into a cavity 34 formed in base 16. To interconnect the various components together in the manner shown in FIG. 9, a threaded nut 36 is threaded over second threaded end 28*b* of connector rod 28 and cinched down against the inner wall 34*a* of cavity 34 of the base 16.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An award construction comprising:

(a) a supporting base having an upper surface and a lower surface;

(b) a decorative member connected to said supporting base, said decorative member including a molded body having:

(i) a front surface having a central portion circumscribed by a marginal portion;

(ii) a back surface having an upper portion and a lower portion, said lower portion having a first threaded bore formed therein; and (iii) a lower portion having a second threaded bore and a pair of spaced apart surface engaging protuberances formed thereon;

(c) connector means for interconnecting said decorative member with said supporting base, said connector means comprising a threaded rod having a first threaded end threadably receivable within said second threaded bore of said lower portion of said decorative member; and (d) a support rod having a surface engaging first end and a second threaded end, said second threaded end being threadably received within said first threaded bore formed and said back surface of said molded body.

2. The award construction as defined in claim 1 which said threaded rod has a threaded second end and in which said award construction further includes a nut threadably connected to said second end of said threaded rod.

3. The award construction as defined in claim 1 in which said supporting base has a cavity for housing said nut and at least a portion of said second end of said threaded rod.

4. The award construction as defined in claim 1, further including a spacer disposed between said supporting base and said decorative member, said threaded rod extending through said spacer.

5. The award construction as defined in claim 1 in which said decorative member further includes hanger means connected to said back surface of said molded body for hanging the molded body on a vertical surface.

6. The apparatus as defined in claim 5 in which said hanger means comprises a hanger member pivotally connected to said back surface of said molded body.

7. An award construction comprising:

(a) a supporting base having an upper surface and a lower surface;

(b) a decorative member connected to said supporting base, said decorative member including a molded body having:

(i) a front surface having a central portion circumscribed by a marginal portion;

(ii) a back surface having an upper portion and a lower portion, said lower portion having a first threaded bore formed therein; and (iii) a lower portion having a second threaded bore and a pair of spaced apart surface engaging protuberances formed thereon;

(c) connector means for interconnecting said decorative member with said supporting base, said connector means comprising a threaded rod having a first threaded end threadably receivable within said second threaded bore of said lower portion of said decorative member;

(d) a support rod having a surface engaging first end and a second threaded end, said second threaded end being threadably received within said first threaded bore formed and said back surface of said molded body; and (e) hanger means connected to said back surface of said molded body for hanging the molded body on a vertical surface, said hanger means comprises a hanger member pivotally connected to said back surface of said molded body.

8. The award construction as defined in claim 7 which said threaded rod has a threaded second end and in which said award construction further includes a nut threadably connected to said second end of said threaded rod.

9. The award construction as defined in claim 7 in which said supporting base has a cavity for housing said nut and at least a portion of said second end of said threaded rod.

10. The award construction as defined in claim 7, further including a spacer disposed between said supporting base and said decorative member, said threaded rod extending through said spacer.

11. An award construction comprising:

(a) a supporting base having an upper surface and a lower surface;

(b) a decorative member connected to said supporting base, said decorative member including a molded body having:

(i) a front surface having a central portion circumscribed by a marginal portion;

(ii) a back surface having an upper portion and a lower portion, said lower portion of said back surface having a first threaded bore formed therein; and (iii) a lower portion having a second threaded bore and a pair of spaced apart surface engaging protuberances formed thereon; and (iv) a support rod having a surface engaging first end and a second threaded end, said second threaded end being threadably received within said first threaded bore formed and said back surface of said molded body; and (c) connector means for interconnecting said decorative member with said supporting base, said connector means comprising a threaded rod having a first threaded end threadably receivable within said second threaded bore of said lower portion of said decorative member.

12. An award construction comprising:

(a) a supporting base having an upper surface and a lower surface;

(b) a decorative member connected to said supporting base, said decorative member including a molded body having:

(i) a front surface having a central portion circumscribed by a marginal portion;

(ii) an ornamental plaque affixed to said central portion of said front surface;

(iii) a back surface having an upper portion and a lower portion, said lower portion of said back surface having a first threaded bore formed therein; and (iv) a lower portion having a second threaded bore and a pair of spaced apart surface engaging protuberances formed thereon; and (c) connector means for interconnecting said decorative member with said supporting base, said connector means comprising a threaded rod having a first threaded end threadably receivable within said second threaded bore of said lower portion of said decorative member.

13. An award construction comprising:

(a) a supporting base having an upper surface and a lower surface;

(b) a decorative member connected to said supporting base, said decorative member including a molded body having:

(i) a front surface having a central portion circumscribed by a marginal portion;

(ii) a back surface having an upper portion and a lower portion, said lower portion of said back surface having a first threaded bore formed therein;

(iii) hanger means connected to said back surface of said molded body for hanging the molded body on a vertical surface; and (iv) a lower portion having a second threaded bore and a pair of spaced apart surface engaging protuberances formed thereon; and (c) connector means for interconnecting said decorative member with said supporting base, said connector means comprising a threaded rod having a first threaded end threadably receivable within said second threaded bore of said lower portion of said decorative member.

14. The apparatus as defined in claim 13 in which said hanger means comprises a hanger member pivotally connected to said back surface of said molded body.

* * * * *